US006332832B1

(12) United States Patent
Suzuki

(10) Patent No.: US 6,332,832 B1
(45) Date of Patent: Dec. 25, 2001

(54) CMP POLISH PAD AND CMP PROCESSING APPARATUS USING THE SAME

(75) Inventor: Keisuke Suzuki, Kyoto (JP)

(73) Assignee: Rohm Company, Ltd., Kyoto (JP)

( * ) Notice: Subject to any disclaimer, the term of this patent is extended or adjusted under 35 U.S.C. 154(b) by 0 days.

(21) Appl. No.: 09/546,171

(22) Filed: Apr. 11, 2000

(30) Foreign Application Priority Data

Apr. 19, 1999 (JP) ..... 11-111126

(51) Int. Cl.[7] ..... B23F 21/03
(52) U.S. Cl. ..... 451/41; 451/527; 451/533
(58) Field of Search ..... 451/41, 527, 285–288, 451/446, 530, 533, 548, 550

(56) References Cited

U.S. PATENT DOCUMENTS 4,055,029 * 10/1977 Kalbow ..... 451/533 X
4,059,929 * 11/1977 Bishop ..... 451/60
5,127,197 * 7/1992 Brukvoort et al. ..... 451/533
5,525,100 * 6/1996 Kell et al. ..... 451/539 X
5,584,146 * 12/1996 Shamouillan et al. ..... 451/285 X
5,692,950 * 12/1997 Rutherford et al. ..... 451/533 X
5,853,317 * 12/1998 Yamamoto ..... 451/527 X
5,913,713 * 6/1999 Cheek et al. ..... 451/285 X
5,922,620 * 7/1999 Shimomura et al. ..... 451/60 X
5,958,794 * 9/1999 Bruxvoort et al. ..... 451/539 X
6,126,531 * 10/2000 Lida et al. ..... 451/60

FOREIGN PATENT DOCUMENTS 8-132342 5/1996 (JP) .

* cited by examiner

*Primary Examiner*—Joseph J. Hail, III
*Assistant Examiner*—Anthony Ojini
(74) *Attorney, Agent, or Firm*—Arent Fox Kintner Plotkin & Kahn, PLLC

(57) ABSTRACT

A CMP polish pad used to chemically and mechanically polish a work to be polished. The CMP polish pad has polishing portions of two or more types, that have different conditions of contact with the work, provided on the pad surface. For example, polishing portions of a plurality of types having different coefficients of elasticity with respect to compression in the direction of pressing against the work may be provided on the pad surface. Also polishing portions of a plurality of types having different areas of contact with the work may be provided on the pad surface. Further, polishing portions of a plurality of types having different heights above the pad surface may be provided on the pad surface.

20 Claims, 10 Drawing Sheets

CM P POLISH PAD AND CMP PROCESSING APPARATUS USING THE SAME

BACKGROUND OF THE INVENTION

1. Field of the Invention

The present invention relates to a CMP (Chemical Mechanical Polishing) pad used in chemically and mechanically polishing a work such as a semiconductor substrate (wafer), and a CMP processing apparatus using the same.

2. Description of Related Art

In a process of producing semiconductor devices, such a treatment is carried out that makes a wafer surface flat and smooth as required. The chemical and mechanical polishing (CMP) process has come to be regarded as a promising process for making a wafer surface smooth and flat.

A CMP processing apparatus comprises a polish head that rotates while holding a wafer, a polish pad disposed to face the polish head, a platen that holds the polish pad, and a slurry supply unit that supplies a polishing medium (slurry) including a chemical liquid and abrasive particles (made of alumina, for example) onto the polish pad. With this constitution, when a wafer is pressed against the polish pad while rotating the polish head, the surface of the wafer is chemically and mechanically polished by the actions of the chemical liquid and the abrasive particles. The platen is adapted to move along the wafer surface, so that the polishing operation is carried out while changing the contact position between the polish pad and the wafer.

The polish pad has such a laminated structure as, for example, a hard pad having a relatively high coefficient of elasticity is laminated on a soft pad having a relatively low coefficient of elasticity. The coefficient of elasticity with respect to compression in the direction of pressing against the wafer to be polished is uniform throughout the pad surface.

Another polish pad of such a configuration has been proposed as the so-called fixed abrasive particles type where abrasive particles are fixed onto the pad surface. In this case, it suffices to supply only a chemical liquid onto the polish pad. The polish pad of this constitution comprises abrasive particles of substantially the same size and the same shape disposed on the pad surface to be uniformly distributed thereon, with all abrasive particles making contact with the wafer under substantially the same condition.

With the polish pads described above, condition of contact with the work being polished is constant throughout the pad surface. Although this constitution has such an advantage that the surface of the work can be polished uniformly, it may not necessarily provide advantage at all times since only a certain fixed condition of polish can be achieved.

In case it is desired to polish roughly at a high polishing rate in an early stage of the polishing process and carry out fine polish in the last stage of the polishing process, for example, the polish pad must be changed in the course of the polishing process. In practice, it is required to transfer the wafer from one CMP processing apparatus to another CMP processing apparatus. This may result in more complex and larger production apparatus.

SUMMARY OF THE INVENTION

An object of the present invention is to provide a CMP polish pad capable of achieving polished states of a plurality of types with a single CMP polish pad.

Another object of the present invention is to provide a CMP processing apparatus capable of achieving polished states of a plurality of types with a single CMP pad.

The CMP pad of the present invention has at least two types of polishing portions, having different contact conditions with the work to be polished, provided on the pad surface.

In the constitution described above, polishing portions of at least two types are provided on the pad surface having different contact conditions with the work to be polished. Accordingly, two or more types of polished states can be achieved.

Such a constitution may be employed, for example, as the polishing portions of at least two types include polishing portions of a plurality of types having different coefficients of elasticity with respect to compression in the direction of pressing against the work to be polished.

The polishing portions of at least two types may also include polishing portions of a plurality of types having different areas of contact with the work to be polished.

The polishing portions of at least two types may also include polishing portions of a plurality of types having different heights above the pad surface.

The polishing portions of at least two types may also include polishing portions of a plurality of types having different shapes of contact areas with the work to be polished.

Such a constitution may be employed, for example, as a polishing portion of high coefficient of elasticity and a polishing portion of low coefficient of elasticity are provided, with the polishing portion of high coefficient of elasticity being formed to be lower than the polishing portion of low coefficient of elasticity in height. In this case, when the work to be polished is pressed hard against the polish pad, the work can be polished by both the polishing portion of high coefficient of elasticity and the polishing portion of low coefficient of elasticity. It is also made possible to put only the polishing portion of low coefficient of elasticity into contact with the work by decreasing the force of pressing the work against the polish pad. This makes it possible to achieve two types of polished state by controlling the pressing force.

For this purpose, for example, area of the polishing portion of high coefficient of elasticity in contact with the work may be set greater than the area of the polishing portion of low coefficient of elasticity in contact with the work. Thus two kinds of polished states can be achieved: rough polish using both the polishing portions of high coefficient of elasticity and the polishing portion of low coefficient of elasticity, and fine polish using only the polishing portion of low coefficient of elasticity.

Such a constitution may also be employed as the surface of the polishing portion of high coefficient of elasticity that makes contact with the work to be polished is made in a shape having sharp edges (for example, straight edges) and the surface of the polishing portion of low coefficient of elasticity that makes contact with the work to be polished is made in a relatively smooth shape (for example, a shape that has only smoothly curved edges or a curved surface without any edges). Thus two kinds of polished states can be achieved: rough polish using both the polishing portion of high coefficient of elasticity and the polishing portion of low coefficient of elasticity, and fine polish using only the polishing portion of low coefficient of elasticity.

Each polishing portion may also comprise a contact portion that touches the work and an elastic body that carries the contact portion on the pad surface. In this case, the polishing portion of high coefficient of elasticity and the polishing portion of low coefficient of elasticity can be formed by setting the coefficient of elasticity of the elastic body to appropriate values. Also height of each polishing portion can be set by setting the height of the elastic body and/or the contact portion to appropriate value.

The contact portion that makes contact with the work may be made of a urethane pad or the like, or comprise abrasive particles made of such a material as alumina, silica or cerium oxide.

The polishing portion of each type is preferably distributed substantially uniformly over the pad surface.

This constitution makes it possible to achieve satisfactory polished state since the surface to be polished of the work can be polished uniformly with the polishing portion of each type.

Polishing portions of individual types are preferably disposed, for example, in a symmetrical arrangement on the pad surface. Specifically, the polishing portions of each type may be disposed in a centrosymmetrical arrangement with respect to the center of the pad surface or axisymmetrial arrangement with respect to the centerline of the pad surface.

The CMP processing apparatus according to the present invention comprises the CMP polish pad having such features as described above, a holding mechanism that holds the work to be polished, and a drive mechanism that is capable of changing the contact condition of the work with the CMP polish pad by moving the holding mechanism relative to the CMP pad, approaching thereto or departing therefrom.

With this constitution, at least two kinds of polished states can be achieved by combining the polish pad of the constitution described above, since the force to press the work held by the holding mechanism against the polish pad can be changed.

The objects described above, other objects, features and effects of the present invention will becomes apparent from the following description of preferred embodiments with reference to the accompanying drawings.

DESCRIPTION OF PREFERRED EMBODIMENTS

Figure 1:
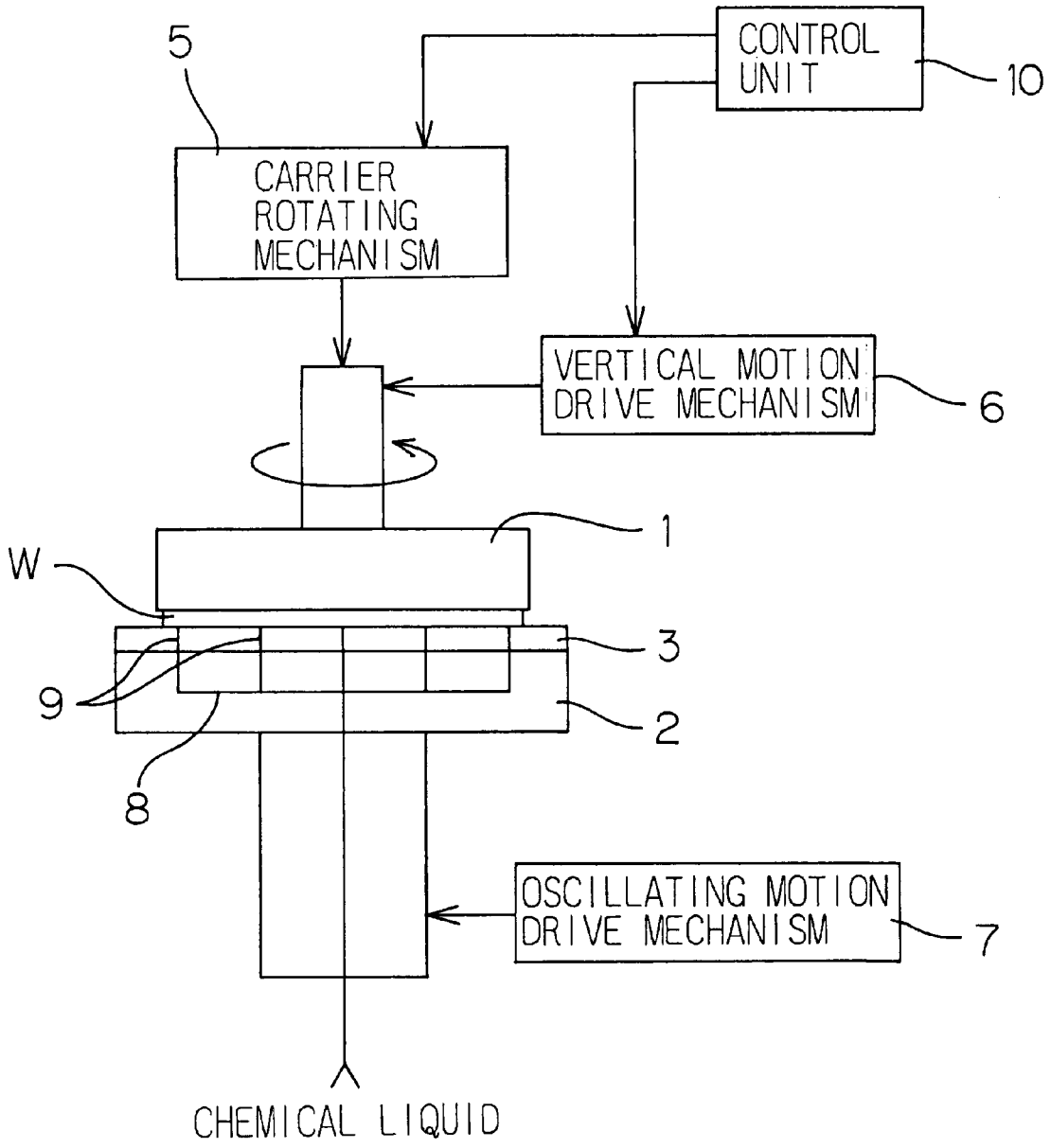
FIG. 1 is a schematic drawing showing the essential constitution of a CMP processing apparatus according to an embodiment of the present invention.

FIG. 1 is a schematic drawing showing the essential constitution of a CMP processing apparatus according to an embodiment of the present invention. The CMP processing apparatus is used to make the surface of a semiconductor wafer W (a silicon wafer, for instance) as a work to be polished flat and smooth. This apparatus has a wafer carrier 1 that holds the wafer W with the front surface thereof facing downward by applying suction force on the back surface thereof, and a polish table (platen) 2 disposed to face the wafer carrier 1. The polish table 2 has a polish pad 3 sticking on the top surface thereof.

The wafer carrier 1, is driven to rotate about a vertical axis by a carrier rotating mechanism 5, and is moved by a vertical motion drive mechanism 6 to approach or depart from the polish pad 3. Thus the wafer W rotates while being pressed against the polish pad 3 thereby to rub against the surface of the polish pad 3. The vertical motion drive mechanism 6 is adapted to be capable of adjusting the force to press the wafer W against the polish pad 3 through control by a control unit 10.

The polish table 2 is driven by an oscillating motion drive mechanism 7 to oscillate while tracing a small circular track in horizontal plane, thereby to constantly change the position of contact with the wafer W. The polish table 2 has a chemical liquid supply passage 8 formed therein, with the chemical liquid supply passage 8 communicating with a processing liquid supply port 9 that opens at the polish pad 3. This configuration makes it possible to polish the wafer W while supplying the chemical liquid between the wafer W and the polish pad 3.

The polish pad 3 is of fixed abrasive particles type wherein abrasive particles such as alumina powder are fixed on the surface thereof. Chemical and mechanical polishing of the surface of the wafer W is achieved by rubbing the surface of the wafer W using the polish pad 3 and the chemical liquid described above.

Figure 2:
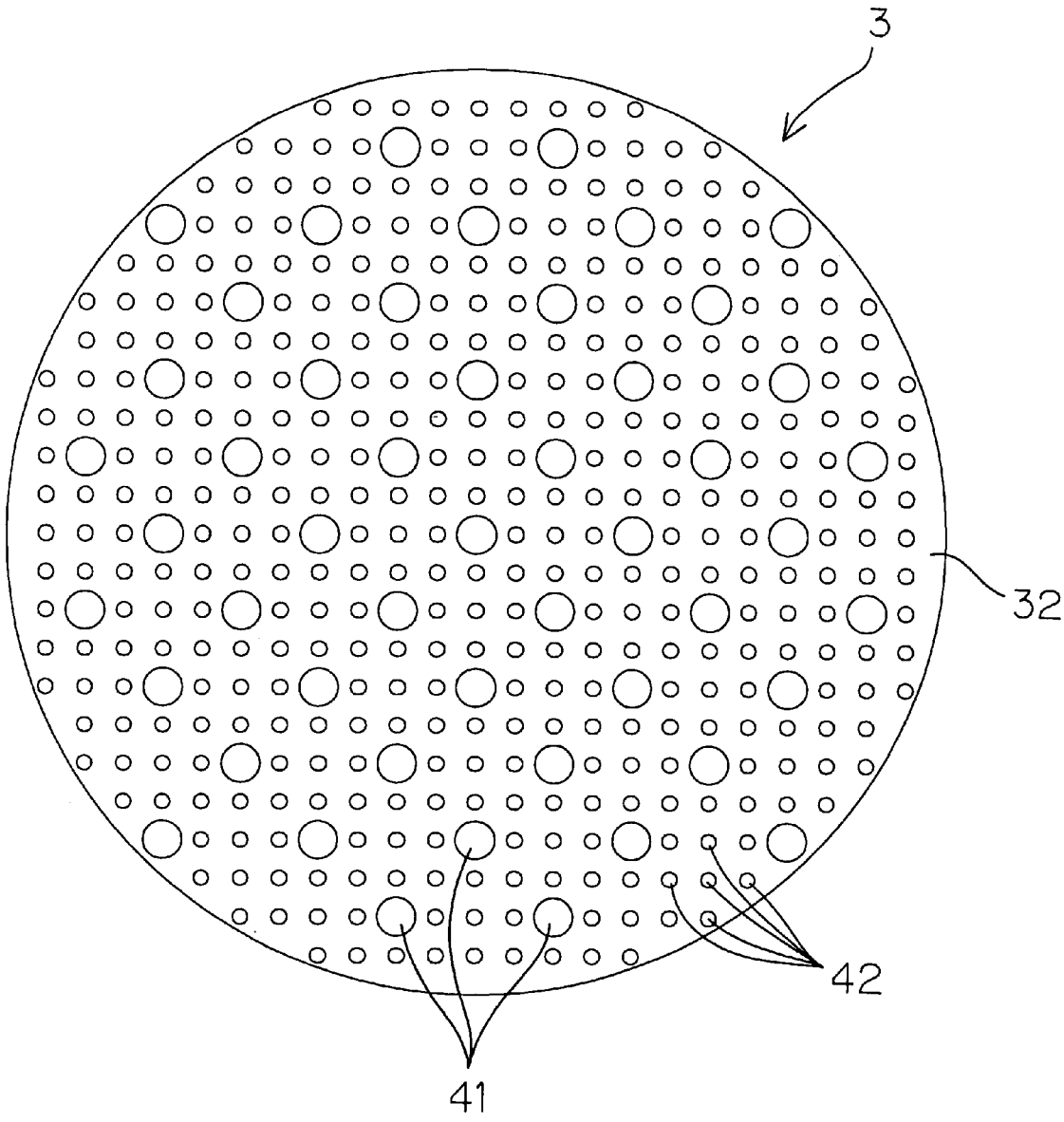
FIG. 2 is a plan view showing an example of constitution of polish pad.
Figure 3:
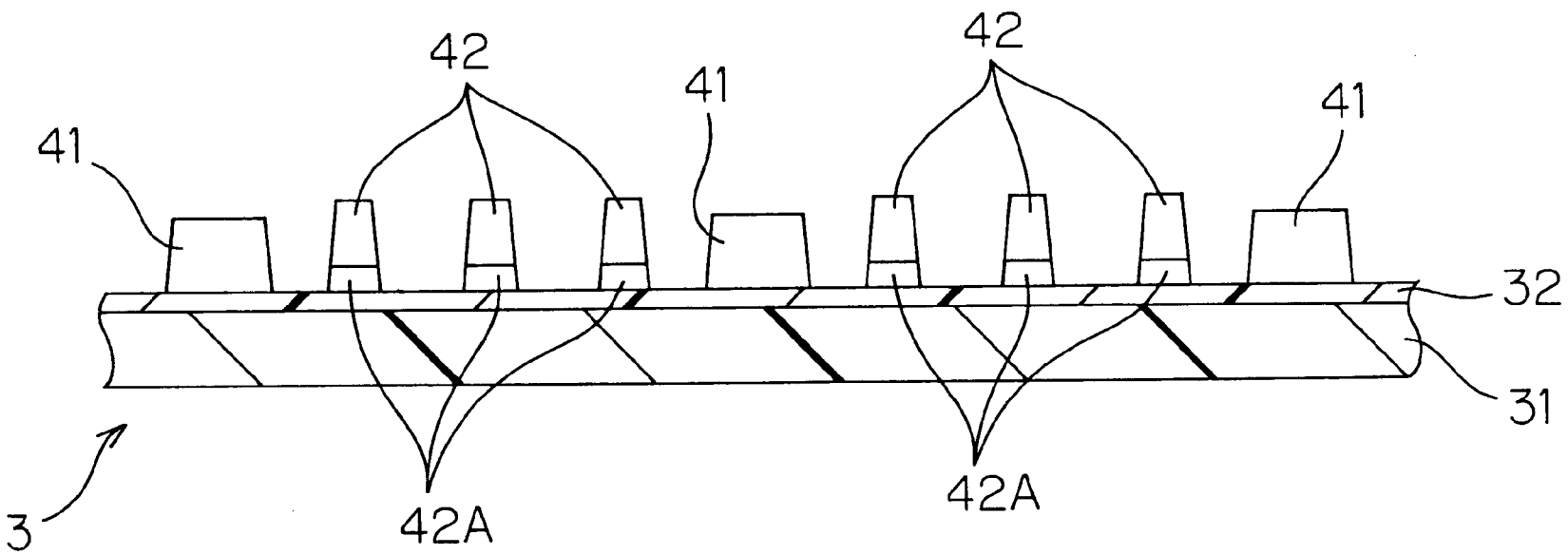
FIG. 3 is a partially enlarged sectional view of the polish pad described above.

FIG. 2 is a plan view showing an example constitution of the polish pad 3, and FIG. 3 is a partially enlarged sectional view of the same. The polish pad 3 is made by laminating a hard layer 32 on a soft layer 31, and fastening a plurality of first polishing portions 41 (polishing portions of high coefficient of elasticity) and a plurality of second polishing portions 42 (polishing portions of low coefficient of elasticity) on the surface of the hard layer 32. The first polishing portions 41 and the second polishing portions 42 are constituted to have different conditions for contact with the work to be polished, each distributed uniformly over the pad surface of the polish pad 3. Specifically, the first and the second polishing portions 41, 42 are disposed in substantially centrosymmetrical arrangement with respect to the center of the disk-shaped polish pad 3.

Figure 4:
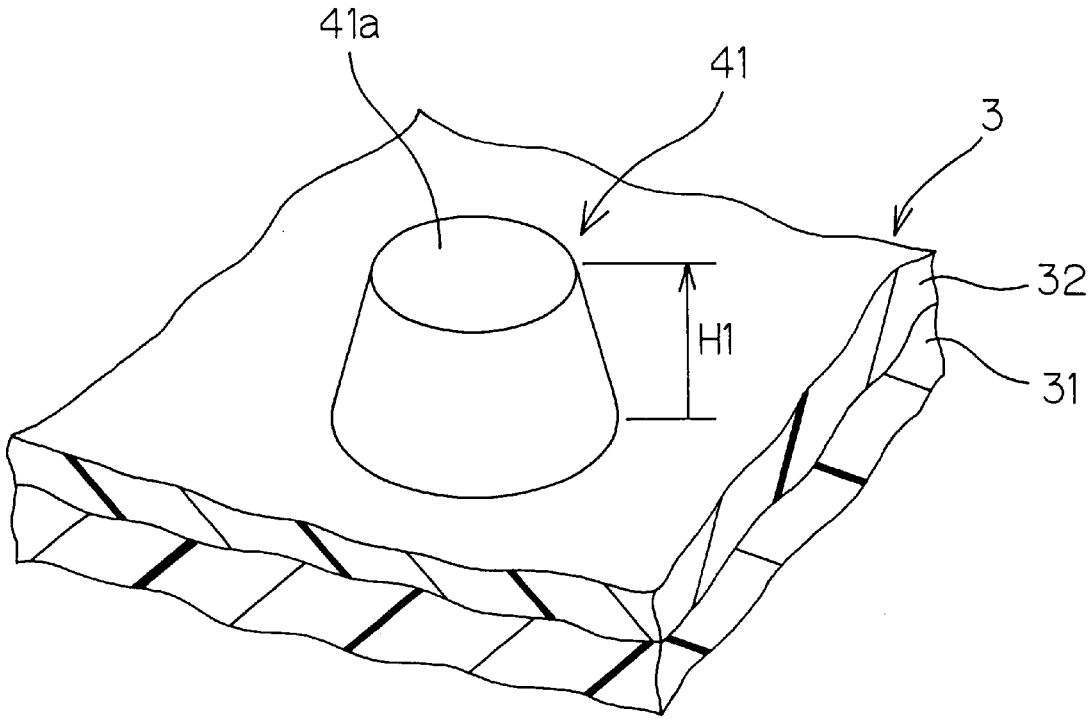
FIG. 4 is an enlarged perspective view showing the constitution of a first polishing portion.

The first polishing portion 41 comprises abrasive particles fastened on the surface of the hard layer 32. The first polishing portion 41 is formed in a substantially truncated conical shape as shown in the enlarged view of FIG. 4.

Figure 5:
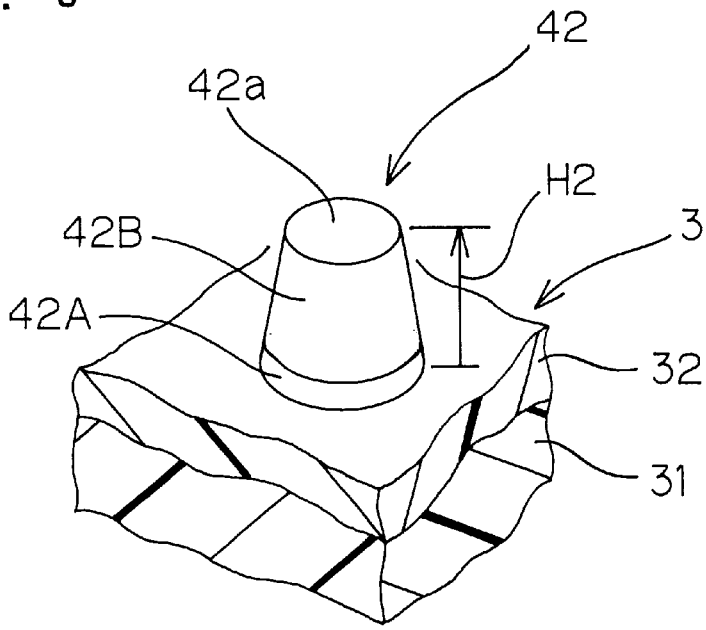
FIG. 5 is an enlarged perspective view showing the constitution of a second polishing portion.

The second polishing portion 42 comprises an elastic body 42A fastened on the surface of the hard layer 32 and abrasive particles 42B formed in a substantially truncated conical shape fastened on the top surface of the elastic body 42A, as shown in the enlarged view of FIG. 5. Thus coefficient of elasticity of the second polishing portion 42 in the direction of pressing against the work is lower than the coefficient of elasticity of the first polishing portion 41 in the direction of pressing against the work due to the elastic body 42A interposed therebetween.

Area of a top surface 42*a* of the second polishing portion 42 is smaller (for example, about one tenth) than that of a top surface 41*a* of the first polishing portion 41. Height H2 of the second polishing portion 42 above the hard layer 32 is set greater than height H1 of the first polishing portion 41 above the hard layer 32.

When the vertical motion drive mechanism 6 is operated to control the force of pressing the wafer W against the polish pad 3 with the constitution described above, two kinds of polished states can be achieved: polishing of the wafer W surface by both the first polishing portions 41 and the second polishing portions 42 (rough polish) and polishing of the wafer W surface by only the second polishing portions 42 (fine polish). That is, pressing the wafer W against the polish pad 3 with a strong force causes the elastic body 42A to contract so that both the top surfaces 41*a*, 42*a* of the first and second polishing portions 41, 42 make contact with the surface of the wafer W, thereby performing rough polish. When the wafer W is pressed against the polish pad 3 with a relatively weak force and the amount of elastic deformation of the elastic body 42A is regulated so that the top surfaces 41*a* of the first polishing portions 41 do not reach the wafer W while the top surfaces 42*a* of the second polishing portions 42 make contact with the surface of the wafer W, fine polish can be performed.

Since the two types of polished states can be achieved with a single unit of CMP processing apparatus without changing the polish pad 3, it is made possible to contribute to the reduction of the size of the processing apparatus and improvement of the semiconductor device production efficiency.

Figure 6A:
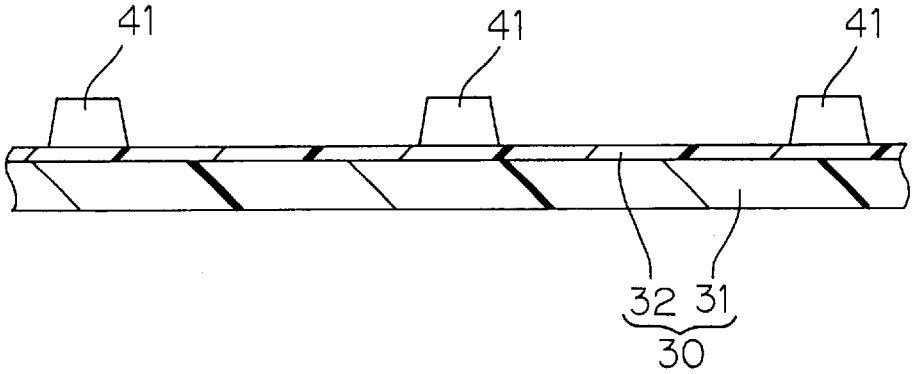
FIGS. 6A through 6C are sectional views showing an example of method of producing the polish pad.
Figure 6B:
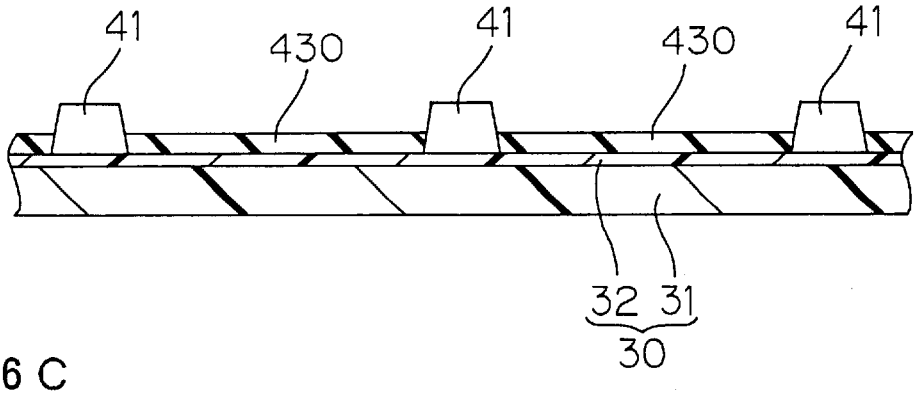
Figure 6C:
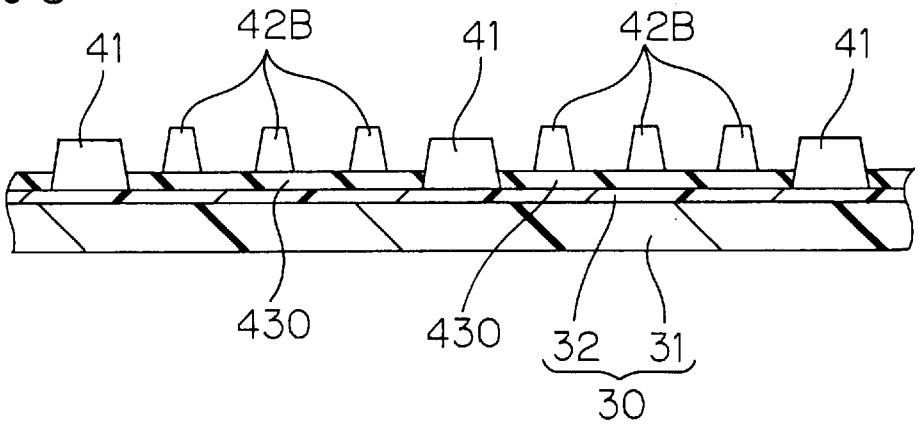

FIGS. 6A through 6C are sectional views showing an example of method of producing the polish pad 3. First, as shown in FIG. 6A, abrasive particles (alumina particles, for instance) that constitute the first polishing portions 41 are fastened onto the surface of a pad substrate 30 whereon the soft layer 31 and the hard layer 32 are laminated.

Next as shown in FIG. 6B, rubber that constitutes the elastic body 42A of the second polishing portions 42 is coated over the entire surface, for example, there by forming a rubber layer 430 (elastic layer). Then as shown in FIG. 6C, abrasive particles 42B (for example, abrasive particles such as alumina, silica or cerium oxide) of the second polishing portions 42 are fastened on the rubber layer 430.

While the constitution shown in FIG. 6C and the constitution shown in FIG. 3 are different in whether the elastic bodies 42A are separately provided for individual second polishing portions 42 or the single rubber layer 430 constitutes a common elastic body for the second polishing portions 42, this difference in the constitution is not essential as far as the process of polishing the wafer W is concerned.

Figure 7:
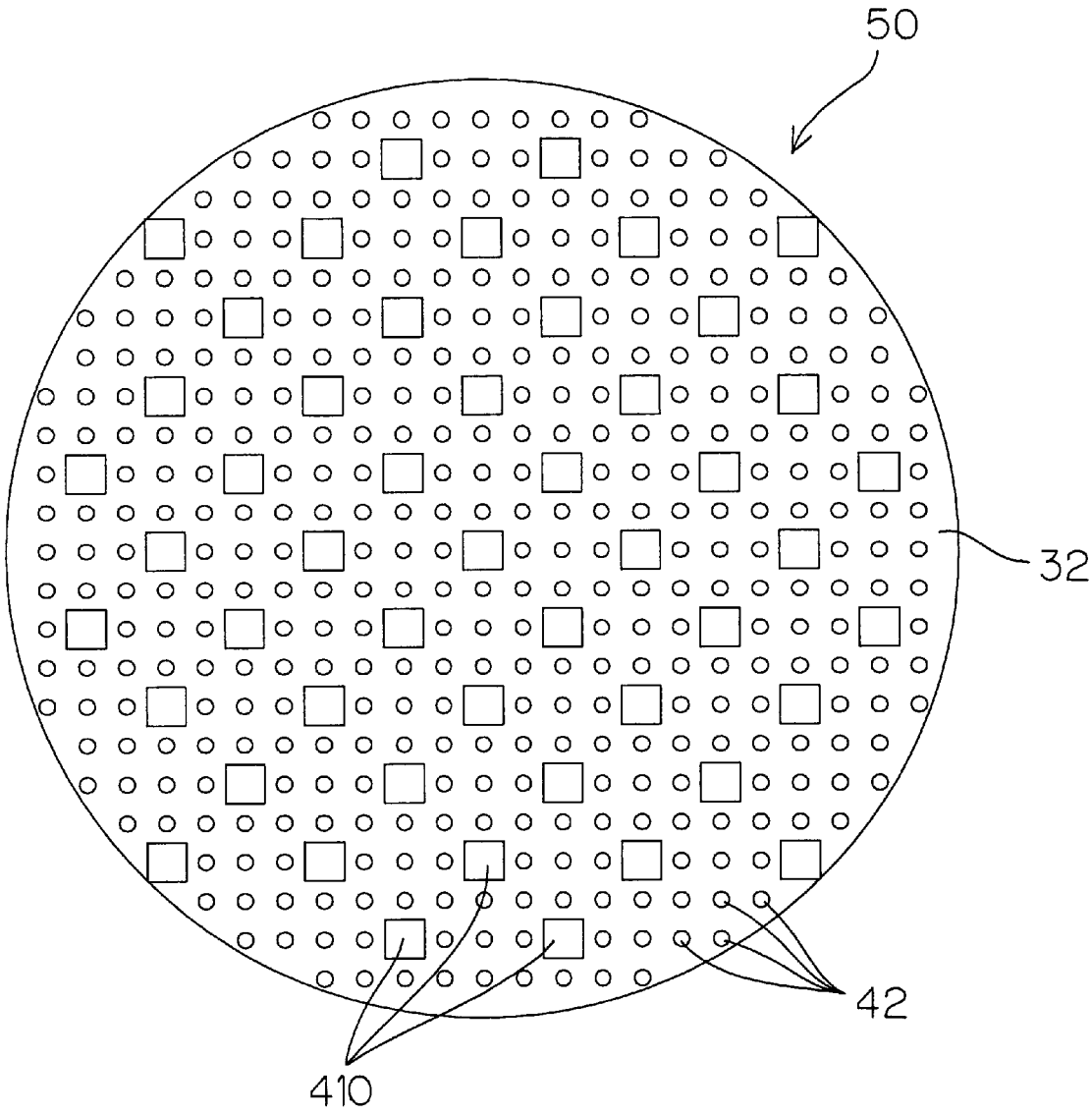
FIG. 7 is a plan view showing the constitution of a polish pad according to the second embodiment of the present invention.

FIG. 7 is a plan view showing the constitution of a polish pad 50 according to the second embodiment of the present invention. The polish pad 50 is to be used instead of the polish pad 3 in the constitution shown in FIG. 1. The polish pad 50 of this embodiment has substantially the same constitution as that of the polish pad 3 of the first embodiment except that a first polishing portions 410 are each made in a pyramidal shape (square pyramid in FIG. 7). Therefore, components that correspond to those of FIG. 2 and FIG. 3 will be denoted in FIG. 7 with the same reference numerals as those used in FIG. 2 and FIG. 3.

Figure 8:
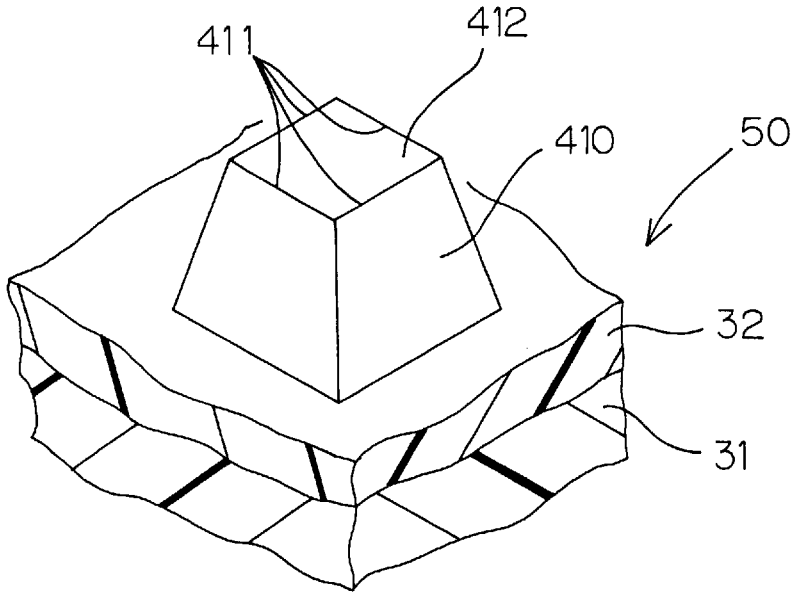
FIG. 8 is an enlarged perspective view showing the constitution of a first polish portion.

FIG. 8 is an enlarged perspective view showing the constitution of the first polishing portion 410. The first polishing portion 410 has a square top surface 412 that has straight edges 411 on four sides thereof, the top surface 412 having an area larger than that of the top surface 42*a* of the second polishing portion 42 (refer to FIG. 5).

When the first polishing portions 410 are put into contact with the wafer W, higher polishing rate can be obtained by using the polishing pad 50 having the constitution described above.

Figure 9:
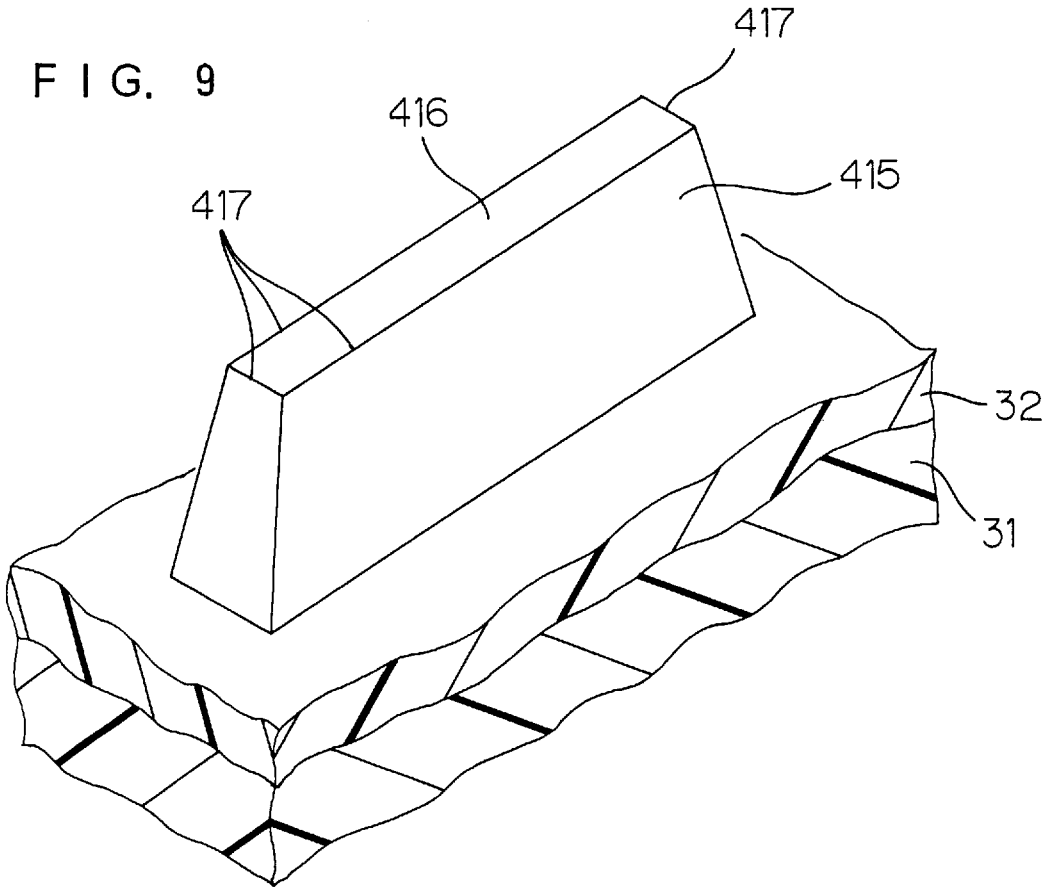
FIG. 9 is a perspective view showing a variation of a polishing portion for rough polish.

This embodiment may be modified further to use polishing portions 415 each comprising abrasive particles of a shape shown in FIG. 9 instead of the first polishing portions 410. The polishing portion 415 has a rectangular top surface 416 and the sides of the top surface 416 form the straight edges 417. This constitution makes it possible to achieve higher polishing rate.

Figure 10:
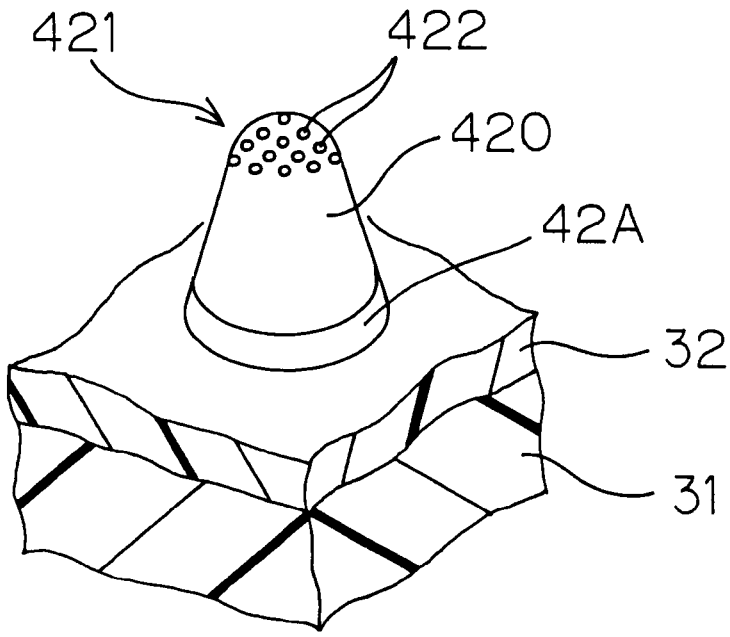
FIG. 10 is a perspective view showing a variation of a polishing portion for fine polish.

A polishing portion 421 shown in FIG. 10 may also be used instead of the second polishing portion 42, the polishing portion 421 having abrasive particles 420 of a shape shown in FIG. 10 provided on the elastic body 42A. The abrasive particle 420 has a smoothly curved surface around the top. Numeral 422 denotes fine particles of an abrasive material such as alumina, silica or cerium oxide.

Use of the polishing portion 421 shown in FIG. 10 makes it possible to carry out fine polishing more precisely.

For the combination of the first polishing portion and the second polishing portion, various modifications can be made in terms of size and shape.

Figure 11:
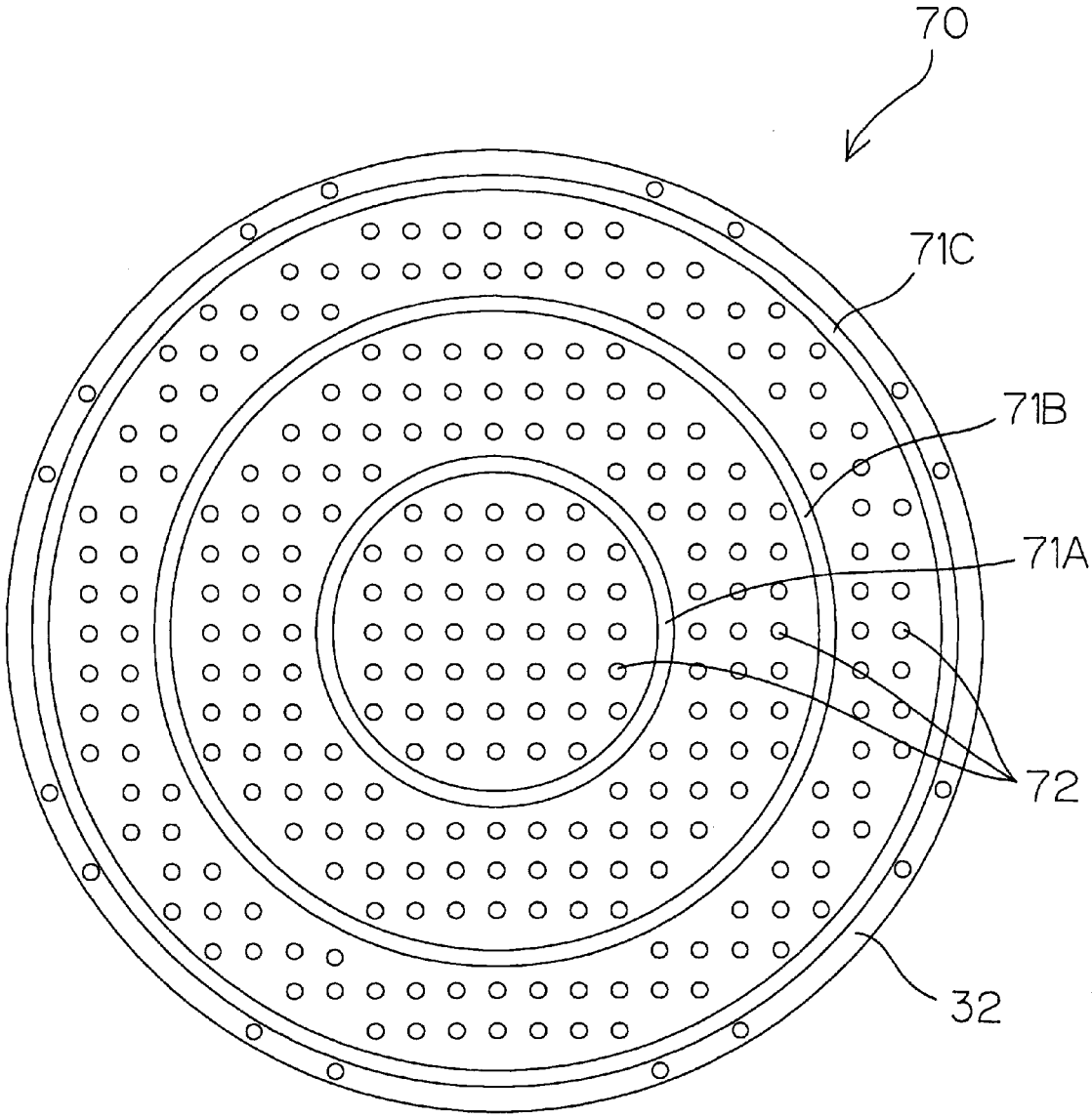
FIG. 11 is a plan view showing the constitution of a CMP polish pad according to the third embodiment of the present invention.

FIG. 11 is a plan view showing the constitution of the CMP polish pad according to the third embodiment of the present invention. In FIG. 11, components that correspond to those of FIG. 2 and FIG. 3 will be denoted with the same reference numerals as those in FIG. 2 and FIG. 3. A polishing pad 70 has substantially disk shape, and has a plurality of first polishing portions 71A, 71B and 71C for rough polishing disposed in a concentric arrangement with the center thereof corresponding to the center of the disk. Disposed at positions offset from the first polishing portions 71A, 71B and 71C are second polishing portions 72 for fine polish uniformly distributed over the pad surface.

Figure 12:
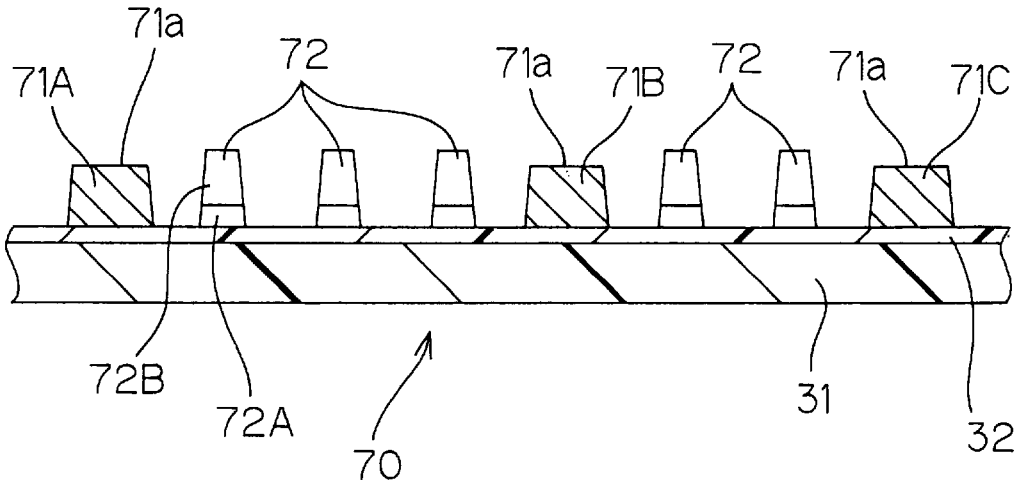
FIG. 12 is a partially enlarged sectional view in the radial direction of the polish pad.

FIG. 12 is a partially enlarged sectional view in the radial direction of the polish pad 70. The first polishing portions 71A, 71B and 71C are formed so that sections perpendicular to the pad surface have substantially trapezoidal shape, and top surfaces 71*a* constitute concentric annular surfaces.

The second polishing portions 72 each has a shape of substantially truncated cone, and has elastic bodies 72A and abrasive particles 72B similarly to the case of the second polishing region 42 of the polishing pad 3 according to the first embodiment described above.

The polish pad 70 is used instead of the polish pad 3 of the constitution shown in FIG. 1. In this case, since the polish table 2 makes oscillating movement to trace a small circle in the horizontal plane instead of rotation, the ring-shaped first polishing regions 71A, 71B and 71C constantly change the position of contact with the wafer W in the radial direction of the wafer W.

In the case of the polish pad 70 of the constitution described above, too, increasing the force of pressing the wafer W against the polish pad 70 compresses the elastic bodies 72A of the second polishing portions 72 so that both the first polishing portions 71A, 71B and 71C and the second polishing portions 72 can make contact with the wafer W, thereby performing rough polish of the wafer W. On the other hand, fine polish of the wafer W can be performed by setting the force of pressing the wafer W against the polish pad 70 to a relatively low level and controlling the amount of compression of the elastic bodies 72A to such a level that the top surfaces of the first polishing portions 71A, 71B and 71C do not touch the wafer W, thereby putting only the second polishing portions 72 into contact with the wafer W.

The second polishing portion 72 may be modified as shown in FIG. 10.

The first polishing portions 71A, 71B and 71C may be modified so that, for example, polishing portions of oval shape in plan view are provided on the pad surface.

Figure 13:
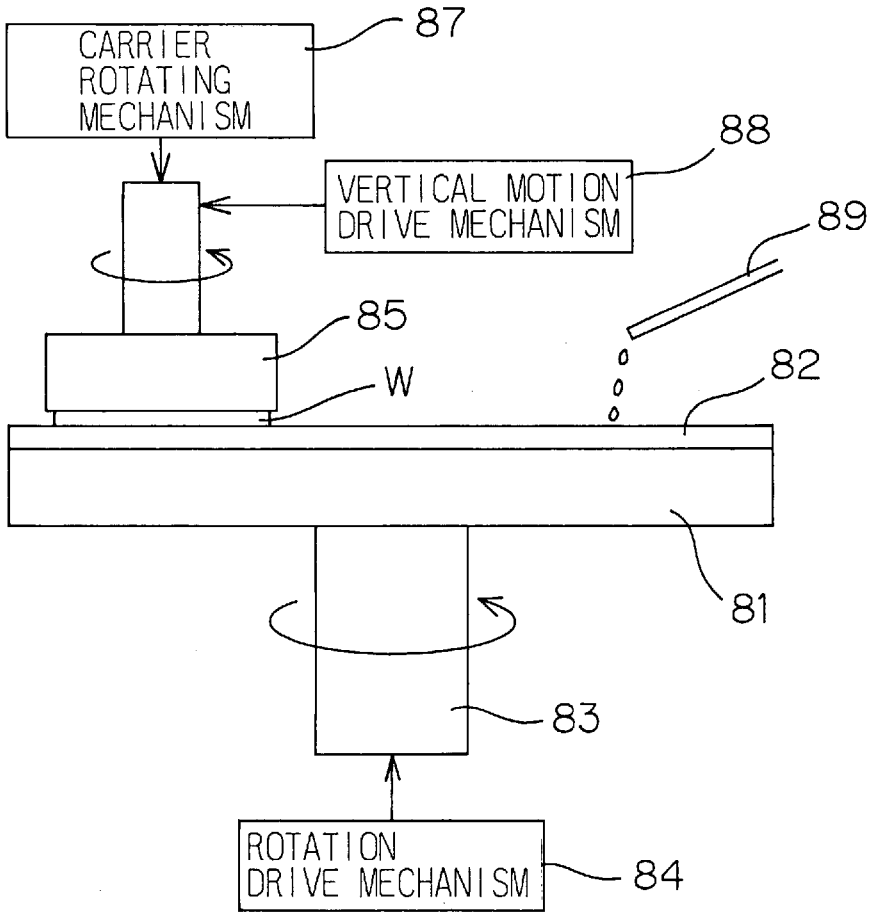
FIG. 13 is a schematic drawing showing the essential constitution of another CMP processing apparatus wherein the present invention is applicable.

FIG. 13 is a schematic drawing showing the essential constitution of another CMP processing apparatus wherein the present invention is applicable. In this apparatus, a polish table 81, that has a relatively large area of a diameter about twice that of the wafer W to be polished, has a disk-shaped polish pad 82 of substantially the same size as that of the polish table 81 fixed thereon. The polish table 81 is driven by a rotation drive mechanism 84 to rotate at a substantially constant speed about a rotation axis 83.

A wafer carrier 85 that holds the wafer W facing downward is disposed at a position offset from the center of the polish pad 82 to press the wafer W against the polish pad 82, and is driven to rotate by a carrier rotation mechanism 87 while being moved by a vertical motion drive mechanism 88 to advance and retract with respect to the polish pad 82. Polishing chemical liquid is supplied from a chemical liquid supply nozzle 89 onto the surface of the polish pad 82 at a position offset from the wafer carrier 85.

In the CMP processing apparatus of the constitution described above, too, 2-step polishing of rough polish and fine polish can be achieved by using a polish pad of similar constitution as that of the polish pads 3, 50, 70 described above as the polish pad 82.

In addition to the constitution described above, there are various CMP processing apparatuses of such a constitution as a polish pad formed in an endless belt configuration is driven to run in the longitudinal direction and a work such as wafer is pressed against the polish pad, or a constitution where a roller-shaped polish pad is driven to rotate about an axis while being pressed against a work. A polish pad comprising the first polishing portion and the second polishing portion as described above can be applied also to the CMP processing apparatus of such constitutions as described above.

Although in the embodiments described above, the polish pad of the so-called fixed abrasive particle type where the abrasive particles are fastened onto the pad surface is used, the present invention may also be applied to a polish pad where the abrasive particles are not fastened onto the pad surface. In this case, it is preferable that a plurality of portions having different coefficients of elasticity in the direction of pressing against the work to be polished are provided on the pad surface. Thus, polishing of a plurality of types can be achieved by controlling the force to press the pad against the work. In the case of this constitution, it is preferable to supply a slurry comprising a chemical liquid with abrasive particles mixed therein onto the polish pad.

Although two types of polished state are achieved in the embodiments described above, three or more types of polished state can be achieved by providing polishing portions of three or more types, having different coefficients of elasticity in the direction of pressing against the work to be polished, on the pad surface and setting different heights and shapes for the polishing portions of different types.

Although elastic bodies are not provided for the first polishing portions 41, 410, 415, 71A, 71B and 71C of the first through third embodiments described above, these first polishing portions may also be provided with elastic bodies interposed between the abrasive particles and the hard layer 32.

The embodiments of the present invention described above should be regarded as mere examples used to exemplify the technical features of the present invention, and that the present invention should not be interpreted as limited by these examples. Spirit and scope of the present invention are limited only by the appended claims.

The present application claims the priority benefit under 35 U.S.C. Section 119 on the basis of Japanese Patent Application No. 11-111126 filed with the Japanese Patent Office on Apr. 19, 1999, the entire disclosure of which is incorporated herein by reference.

What is claimed is:

1. A CMP polish pad used to chemically and mechanically polish a work to be polished, comprising polishing portions of two or more types, having different conditions of contact with the work, provided on a pad surface.

2. The CMP polish pad according to claim 1, wherein the polishing portions of two or more types include polishing portions of a plurality of types having different coefficients of elasticity with respect to compression in a direction of pressing against the work to be polished.

3. The CMP polish pad according to claim 1, wherein the polishing portions of two or more types include polishing portions of a plurality of types having different areas of contact with the work to be polished.

4. The CMP polish pad according to claim 1, wherein the polishing portions of two or more types include polishing portions of a plurality of types having different heights above the pad surface.

5. The CMP polish pad according to claim 1, wherein the polishing portions of two or more types include polishing portions of a plurality of types having surfaces of different shapes making contact with the work to be polished.

6. The CMP polish pad according to claim 1, wherein the polishing portions of two or more types include a high elastic coefficient polishing portion and a low elastic coefficient polishing portion that has a coefficient of elasticity, with respect to compression in the direction of pressing against the work to be polished, lower than that of the high elastic coefficient polishing portion, the low elastic coefficient polishing portion having a height above the pad surface greater than a height of the high elastic coefficient polishing portion.

7. The CMP polish pad according to claim 6, wherein the high elastic coefficient polishing portion has larger area of contact with the work to be polished than the low elastic coefficient polishing portion.

8. The CMP polish pad according to claim 6, wherein the high elastic coefficient polishing portion has sharper edges of contact with the work to be polished than the low elastic coefficient polishing portion.

9. The CMP polish pad according to claim 1, wherein the polishing portions of two or more types include a polishing portion having a contact portion that makes contact with the work to be polished and elastic body that carries the contact portion on the pad surface.

10. The CMP polish pad according to claim 1, wherein the polishing portions of each of the types are distributed substantially uniformly over the pad surface.

11. The CMP polish pad according to claim 1, wherein the polishing portions of each of the types are distributed in an arrangement substantially centrosymmetrical with respect to a center of the pad surface.

12. The CMP polish pad according to claim 1, wherein the polishing portions of two or more types include a polishing portion of truncated conical shape.

13. The CMP polish pad according to claim 1, wherein the polishing portions of two or more types include a polishing portion of truncated pyramidal shape.

14. The CMP polish pad according to claim 1, wherein the polishing portions of two or more types include a polishing portion of ring shape.

15. A CMP processing apparatus, comprising:

a holding mechanism that holds a work to be polished;

a CMP polish pad having polishing portions of two or more types, that have different conditions of contact with the work held by the holding mechanism, provided on the pad surface; and a drive mechanism that is capable of changing the contact condition of the work with the CMP polish pad by moving the holding mechanism relative to the CMP pad, approaching thereto or departing therefrom.

16. The CMP processing apparatus according to claim 15, wherein the polishing portions of two or more types include polishing portions of a plurality of types having different coefficients of elasticity with respect to compression in the direction of pressing against the work to be polished.

17. The CMP processing apparatus according to claim 15, wherein the polishing portions of two or more types include polishing portions of a plurality of types having different areas of contact with the work to be polished.

18. The CMP processing apparatus according to claim 15, wherein the polishing portions of two or more types include polishing portions of a plurality of types having different heights above the pad surface.

19. The CMP processing apparatus according to claim 15, wherein the polishing portions of two or more types include polishing portions of a plurality of types having different shapes of contact surfaces with the work to be polished.

20. The CMP processing apparatus according to claim 15, wherein the polishing portions of each of the types are distributed substantially uniformly over the pad surface.

* * * * *